US009332839B2

(12) United States Patent
Ringlein

(10) Patent No.: US 9,332,839 B2
(45) Date of Patent: May 10, 2016

(54) DESK MOUNTED VERTICALLY ADJUSTABLE STAND UP DESK

(71) Applicant: John Frederick Ringlein, Naperville, IL (US)

(72) Inventor: John Frederick Ringlein, Naperville, IL (US)

( * ) Notice: Subject to any disclaimer, the term of this patent is extended or adjusted under 35 U.S.C. 154(b) by 0 days.

(21) Appl. No.: 14/484,817

(22) Filed: Sep. 12, 2014

(65) Prior Publication Data

US 2016/0073779 A1 Mar. 17, 2016

(51) Int. Cl.

| | |
|---|---|
| ***A47B 57/00*** | (2006.01) |
| ***A47B 87/00*** | (2006.01) |
| ***A47B 21/02*** | (2006.01) |
| ***A47B 21/04*** | (2006.01) |

(52) U.S. Cl.

CPC ..... *A47B 87/002* (2013.01); *A47B 21/02* (2013.01); *A47B 21/04* (2013.01)

(58) Field of Classification Search

CPC ..... A47B 9/20; A47B 9/10; A47B 47/021; A47B 57/06; A47B 57/10; A47B 57/20; A47B 57/30; A47B 57/34; A47B 57/485; A47F 3/06; A47F 3/063

USPC ..... 312/196, 233, 277, 223.3, 7.2; 108/50.01, 50.02, 90, 93, 106, 147, 108/147.19, 147.21; 248/149, 157, 917; 211/187, 153, 134

See application file for complete search history.

(56) References Cited

U.S. PATENT DOCUMENTS

| | | | | | |
|---|---|---|---|---|---|
| 309,360 | A | * | 12/1884 | Roberts | 108/106 |
| 324,602 | A | * | 8/1885 | Solliday | 108/147.11 |
| 780,829 | A | | 1/1905 | La Fayette Stengel | |
| 848,991 | A | * | 4/1907 | Harvey | 108/148 |
| 1,009,902 | A | * | 11/1911 | Hanson | 108/89 |
| 1,153,371 | A | * | 9/1915 | Carter | 248/244 |
| 1,346,586 | A | * | 7/1920 | Barber | A61G 13/06 108/147 |
| 1,361,733 | A | * | 12/1920 | Jones | 108/117 |
| 2,630,359 | A | | 3/1953 | Schade | |
| 2,913,122 | A | | 11/1959 | Lomas | |
| 2,920,244 | A | * | 1/1960 | Miksit et al. | 248/121 |
| 3,280,767 | A | * | 10/1966 | Kahn | 108/147.13 |
| 4,194,452 | A | | 3/1980 | Crowther et al. | |
| 4,513,938 | A | * | 4/1985 | Seymour | 248/507 |
| 4,614,273 | A | * | 9/1986 | Ishii | 211/183 |

(Continued)

FOREIGN PATENT DOCUMENTS

EP 2223629 * 9/2010

OTHER PUBLICATIONS

Ergotron, About Standing Products, 2015 http://www.juststand.org/tabid/660/language/en-US/default.aspx.

(Continued)

*Primary Examiner* — Janet M Wilkens

(74) *Attorney, Agent, or Firm* — Blynn L. Shideler; Krisanne Shideler; BLK Law Group

(57) ABSTRACT

A desk mounted vertically adjustable stand up desk allows a conventional desk to be easily and quickly converted to a stand up desk for the user. The desk mounted vertically adjustable stand up desk includes a base plate adapted to be supported on a desk surface; a tower vertically extending from the base plate; a stand up desk surface member moveably mounted on the tower and configured to be vertically adjustable relative to the base plate; and a lock member coupled to the tower and configured to secure the stand up desk surface member in a desired user selected vertical position.

6 Claims, 11 Drawing Sheets

(56) References Cited

U.S. PATENT DOCUMENTS

| | | | | |
|---|---|---|---|---|
| 5,039,044 | A * | 8/1991 | Sher | 248/125.1 |
| 5,160,104 | A * | 11/1992 | Sher | 248/176.1 |
| 5,549,052 | A | 8/1996 | Hoffman | |
| 5,690,310 | A * | 11/1997 | Brown | 248/448 |
| 5,702,083 | A | 12/1997 | Lai | |
| 5,823,120 | A | 10/1998 | Holmquist | |
| 6,189,849 | B1 * | 2/2001 | Sweere et al. | 248/286.1 |
| 6,615,744 | B1 * | 9/2003 | Eckstein | A47B 9/20 108/140 |
| 7,201,108 | B2 | 4/2007 | Eusebi et al. | |
| 8,152,258 | B2 * | 4/2012 | Kang et al. | 312/408 |
| 8,167,253 | B2 * | 5/2012 | Smith | 248/125.3 |
| 8,181,920 | B2 * | 5/2012 | Brown | 248/125.8 |
| 8,226,184 | B2 * | 7/2012 | Kang et al. | 312/408 |
| 8,418,861 | B1 * | 4/2013 | Weaver et al. | 211/90.02 |
| 8,613,454 | B2 * | 12/2013 | Foley | 280/32.6 |
| 8,671,853 | B2 | 3/2014 | Flaherty | |
| 8,947,215 | B2 * | 2/2015 | Mandel et al. | 340/309.16 |
| 2001/0047742 | A1 * | 12/2001 | Moore | 108/50.01 |
| 2004/0188573 | A1 * | 9/2004 | Weatherly | 248/125.1 |
| 2007/0163475 | A1 | 7/2007 | Murphy | |
| 2008/0203865 | A1 | 8/2008 | Chouinard et al. | |
| 2009/0230064 | A1 * | 9/2009 | Knappe et al. | 211/26 |
| 2009/0230069 | A1 * | 9/2009 | Naden | A47B 49/004 211/144 |
| 2011/0163050 | A1 * | 7/2011 | Grove | 211/26 |
| 2012/0212116 | A1 * | 8/2012 | McRorie et al. | 312/249.13 |
| 2014/0139082 | A1 * | 5/2014 | Green | 312/237 |

OTHER PUBLICATIONS

Ergo Desktop, Kangaroo Pro, Aug. 1, 2002, http://www.ergodesktop.com/content/kangaroo-pro.

Healthy Lifestyle, Nutrition and healthy eating Nutrition-wise blog. Do you have 'sitting disease'?, Mayo Clinic Jul. 25, 2012 http://www.mayoclinic.org/healthy-living/nutrition-and-healthy-eating/expert-blog/sitting-disease/bgp-20056238?p=1.

WebMD, Fitness & Exercise, Do You Have Sitting Disease? Lisa Fields, Jan. 26, 2010, http://www.webmd.com/fitness-exercise/features/do-you-have-sitting-disease?print=true.

* cited by examiner

POHL'S IMPROVED DESK

KOTTMANN'S DESK FOR SITTING AND STANDING ARRANGED FOR SITTING

KOTTMANN'S DESK ARRANGED FOR STANDING

FIG. 10
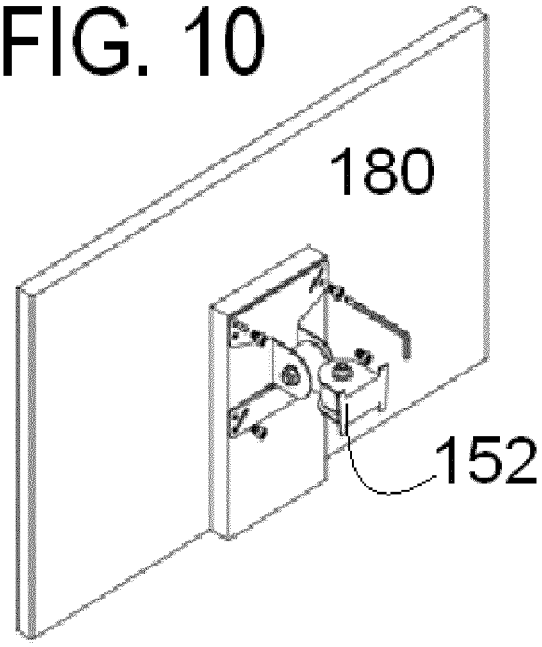
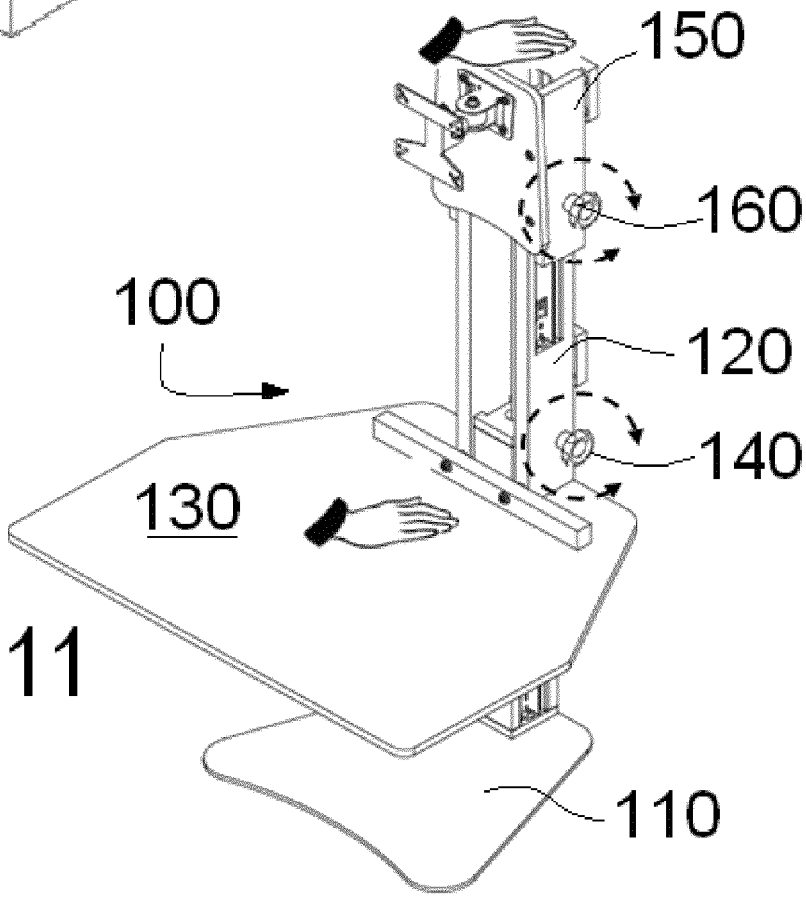
FIG. 11

CLOSED

OPEN

DESK MOUNTED VERTICALLY ADJUSTABLE STAND UP DESK

BACKGROUND OF THE INVENTION

1. Field of the Invention

This invention generally relates to stand up desks, and more particularly to a desk mounted vertically adjustable stand up desk.

2. Background Information

A 2008 Vanderbilt University Study of 6,300 people, published in the *American Journal of Epidemiology*, estimated that the average American spends 55% of waking time (7.7 hours per day) in sedentary behaviors such as sitting. A 2010 American Cancer Society study, published in the *American Journal of Epidemiology*, followed 123,216 individuals from 1993-2006 and concluded that women who sat for over 6 hours per day were 94% more likely to die than those who were physically active and sat for less than 3 hours per day; men who sat for over 6 hours per day were 48% more likely to die than their physically active counterparts. A 2010 British *Journal of Sports Medicine* article also concluded people who sit for long periods of time have an increased risk of disease. A 2010 University of Queensland, School of Population Health study reported that prolonged periods of sitting can compromise metabolic health even in adults who otherwise meet physical activity recommendations. In recent years, as studies have come out sounding the alarm on the ill-effects of excessive sitting, the popularity of stand-up desks has soared.

Those who have read much of the coverage of this trend might be forgiven for thinking that standing to work constitutes a new hip fad. Yet as it is with many things, everything old is new again, as the stand-up desk was well known long before those in Silicon Valley made them the recent rage. The stand up desk has actually been used by a number of famous individuals for centuries.

A Brief History of the Standing Desk

Offices in the 19th century often had communal sitting/standing desks as opposed to individual desks for each employee. Old inventories of furniture from state legislatures and other government bodies during the 19$^{th}$ century often include an entry for stand-up desks. One industrial journal noted a gas company office environment in which the president of the company "stood near the centre of the room, behind a standing desk used by the weigher of the establishment."

Thomas Jefferson, the first U.S. patent examiner (among his many achievements), is perhaps the most famous user of the stand-up desk. His six-legged "tall desk" had an adjustable slanted top that was large enough to place a folio. Jefferson used the desk to draw up brilliant architectural blueprints for buildings like the Virginia State Capitol.

President Jefferson was not the only head of state to favor the standing desk. Prussian Prime Minister Otto von Bismarck would be standing at his desk by five in the morning, ready to sort through all the proposals and business of the day. British Prime Minister Winston Churchill liked to lay out the galley proofs of his next book on a stand up desk, also called an "upright desk," and pore over them, looking for needed corrections.

Many authors felt like standing up to work got their creative juices flowing. Charles Dickens used a stand up desk, as revealed by the description of his study by a visitor: "books all round, up to the ceiling and down to the ground; a standing desk at which he writes; and all manner of comfortable easy chairs." Ernest Hemingway discovered the standing desk method from his editor at Charles Scribner's Sons, Maxwell Perkins. In *Papa Hemingway: A Personal Memoir*, A E Hotchner describes Hemingway's set-up in his home in Havana: "In Ernest's room there was a large desk covered with stacks of letters, magazines, and newspaper clippings, a small sack of carnivores' teeth, two unwound clocks, shoehorns, an unfilled pen in an onyx holder, a wood carved zebra, wart hog, rhino and lion in single file, and a wide-assortment of souvenirs, mementos and good luck charms. He never worked at the desk. Instead, he used a stand up work place he had fashioned out of a bookcase near his bed. His portable typewriter was snugged in there and papers were spread along the top of the bookcase on either side of it. He used a reading board for longhand writing."

In addition to a desire to emulate Jefferson, Bismarck, Churchill, Dickens, Hemingway and other luminaries who have used stand up desks, there are, as suggested above, a number quantifiable benefits to the practice.

1. Increasing Life Expectancy

As noted above several studies have linked passivity to increased mortality. Another recent study found that men who sit for more than six hours of their leisure time each day had a 20% higher death rate than those who sat for three hours or less. The epidemiologist who conducted the study, Alpha Patel, concluded that excessive sitting literally shortens a person's life by several years. A further recent study concluded that men who sat for 23 or more hours a week had a 64% greater chance of dying from heart disease than those who sat for 11 hours per week or less. Louisiana State University's Pennington Biomedical Research Center reviewed numerous studies and concluded that those who sit all day at work were 54% more likely to die of a heart attack.

It has been suggested that sitting is the ultimate passive activity, and that one burns more calories chewing gum than when one is merely slouching in a chair. When sitting it has been suggested that the electrical activity in the muscles flat lines, and the body consequently uses very little energy. Powering down the body like that for long periods of time can lead to a cascade of negative effects. Heart rate, calorie burn, insulin effectiveness, and levels of good cholesterol all drop. The body also stops producing lipoprotein, lipase and other molecules that are only released when flexing muscles, such as when standing and/or walking. These molecules play an important role in processing fats and sugars and without them, the body's metabolism suffers. Add these factors up, and it's no wonder that those who sit for long periods of time each day have larger waistlines and worse blood sugar and blood pressure profiles and are at higher risk of heart disease, diabetes, obesity, and cancer than who sit less.

2. Weight Loss

As mentioned above, when one sits, the heart rate and calorie burn go down. Weight gain typically creeps on gradually from consuming a few too many calories here and there, and slowing down in small ways as we age. One individual test with a heart rate monitor found that the subject's heart rate was 10 beats higher when standing than sitting and the subject burned 54 calories in an hour of sitting as opposed to 72 in an hour of standing. A British study from the University of Chester found standing to burn 42 more calories per hour compared to sitting.

3. Improvement in Back and Neck Health

White collar workers often experience back pain which stems from not using their backs enough. Years of slouching in a chair may take a substantial toll. Standing up engages your back muscles and improves one's posture. Anecdotally, many folks who have made the switch to a stand-up desk have reported that the change cured their back pain. The REP Biometrics Lab in Bend Oreg. concluded that people who sit more are at greater risk for herniated disk and strained cervical vertebrae in the neck leading to permanent imbalances. A 2011 Health Partners study indicated that 75% of people felt healthier overall after standing at work.

4. Improvement in Focus and Concentration

Standing increases one's focus and concentration in several ways. First, a standing individual is less likely to become drowsy and with the muscles engaged the individual stays alert. Second, standing allows the individual to be more active, shift from one leg to another, and pacing as desired, releasing restless energy and improving focus and concentration. A study released by Office Ergonomics Research Committee found a 17.8% productivity gain when employees are supplied with ergonomic furniture, such as a standing desk.

5. Improvements in Sleep

It has been acknowledged than many who begin using a standing desk find they gain a satisfying overall tiredness by the end of the day allowing them to fall asleep fast at the end of the day and quickly move into a restful sleep state. The Office of Obesity Solutions at the Mayo Clinic has further suggested that sitting for long periods of time slows blood circulation and causes fluid to pool in the legs that can lead to restlessness and loss of sleep.

These are merely some of the well known quantifiable advantages offered through a stand up desk. Numerous other studies and insights can be found in the art as can be found at, for example, www.juststand.org, and other articles addressing the "sitting disease."

Combined Stand Up Desk and Sit Down Desk

The field has tried to address the desire for a stand up desk combined with desire to maintain a sit down desk. FIG. 1 illustrates an 1886 desk design attributed to inventor Pohl, published in Scientific American, in which a standing desk 10 and a sitting desk 12 were combined in a back to back fashion. FIGS. 2A and B illustrate a sitting desk 14 believed by an inventor Kottmann, suitable for students (the front of a desk 14 includes a folding chair for the student at a desk 14 immediately in front), that converts to a standing desk shown in FIG. 2B. FIG. 3 represents a commercially available convertible sit down desk to stand up desk design (available from ERGOTRON) in which a desktop surface 16 is vertically adjustable via telescoping legs 18. See also the moveable table design of U.S. Patent Publication 2007-0163475, table with variable configurations of U.S. Pat. No. 7,201,108, vertically adjustable school desk of U.S. Pat. No. 5,823,120, table with moveable surface of U.S. Pat. No. 5,549,052, convertible table of U.S. Pat. No. 4,194,452, convertible table of U.S. Pat. No. 2,913,122, the vertically shiftable platform for office furniture of U.S. Pat. No. 2,630,359, and the adjustable table of U.S. Pat. No. 780,829 which are all incorporated herein by reference. However all of these designs are impractical for the user (or often an employer) that does not want to scrap their existing sit down desks.

Some have designed conversion units that clamp to or around select desk surfaces that add an adjustable monitor support, but these are likewise impractical for those that do not desire to bolt or clamp a unit to their existing desk.

FIG. 4 illustrates a prior art desk 20 mounted stand up or sit down desk 22, described in detail in U.S. Patent Publication 2008-0203865 which is incorporated herein by reference, that sits on a platform 24 supported on the top of the conventional desk 20 and with a separate adjustable keyboard support 26 extending in front of the desk 20. The design is easy to install on a desk 20 but the scissor jack type lifting mechanism between the platform or base 24 and the desk 22, and other design aspects of this invention, minimizes the useful usable surface of the desk 20. Note where the user is located relative to the original desk 20 in either the sitting or standing position.

FIG. 5 illustrates a prior art desk mounted stand up or sit down desk 32, described in detail in U.S. Pat. No. 8,671,853 which is incorporated herein by reference, that sits on a platform 34 supported on the top of the conventional desk 20 (not shown here). This adjustable desktop workspace is disclosed having two pivoting arms mounted between the platform 34 or base and the desk 32, with each pivoting arm having a front and rear bracket. Additionally there are also two stabilizing bars to limit side-to-side relative movement, and a biasing spring between the front and rear brackets to aide moving the upper platform. This design is also easy to install on a desk 20 but the pivoting arm lifting mechanism between the platform or base 34 and the desk 32, and other design aspects of this invention, minimizes the useful usable surface of the desk 20.

In the platform supported desk mounted vertically adjustable stand up desks of the prior art represented in FIGS. 4 and 5 it is difficult to adjust the height of the monitor relative to the desk surface limiting the utility. Additionally these designs usurp too much desk surface which severely limits their application in practice. Many people do not have clear desk spaces that could easily implement the system and implementing a new system becomes less likely if one must undergo a spring cleaning of their desk to adopt the new unit.

It is an object of the present invention to address the deficiencies of the prior art discussed above and to do so in an efficient, cost effective manner to provide a desk mounted vertically adjustable stand up desk that allows a conventional desk to be easily and quickly converted to a stand up desk for the user without detrimentally effecting the desktop surface or requiring bolting or clamping to the desk. Other advantages of the present invention will become apparent from a perusal of the following detailed description of presently preferred embodiments of the invention.

SUMMARY OF THE INVENTION

The various embodiments and examples of the present invention as presented herein are understood to be illustrative of the present invention and not restrictive thereof and are non-limiting with respect to the scope of the invention. The present invention is directed to a stand up desk, but it may also be referenced as a standing desk, an upright desk or a tall desk. For reference, the front of the elements in the present invention reference the side that is closest to the side of the desk upon which the user sits, while the rear is opposed there from, with the sides extending from the front to the rear.

The present invention provides a desk mounted vertically adjustable stand up desk that allows a conventional desk to be easily and quickly converted to a stand up desk for the user. The desk mounted vertically adjustable stand up desk includes a base plate adapted to be supported on a desk surface; a tower vertically extending from the base plate; a stand up desk surface member moveably mounted on the tower and configured to be vertically adjustable relative to the base plate; and a lock member coupled to the tower and configured to secure the stand up desk surface member in a desired user selected vertical position.

These and other advantages of the present invention will be clarified in the description of the preferred embodiments taken together with the attached figures.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 10 is a rear perspective view of the attachment of a monitor to a monitor mount of the desk mounted vertically adjustable stand up desk of FIG. 6;

FIG. 11 is a perspective view of the desk mounted vertically adjustable stand up desk of FIG. 6 illustrating the vertical adjustment;

DESCRIPTION OF THE PREFERRED EMBODIMENTS

Figure 1:
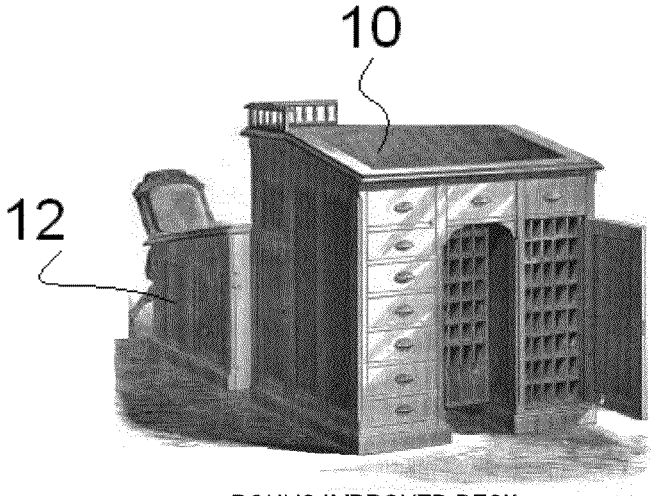
FIG.1 PRIOR ART
FIG. 1 is a perspective view of a prior art combined standing desk and sitting desk.
Figure 2A:
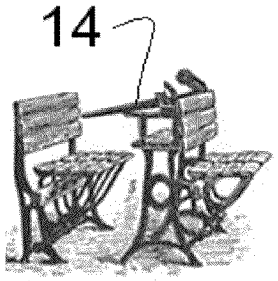
FIG. 2A PRIOR ART
FIGS. 2A and B are perspective views of a convertible sitting desk and standing desk of the prior art.
Figure 2B:
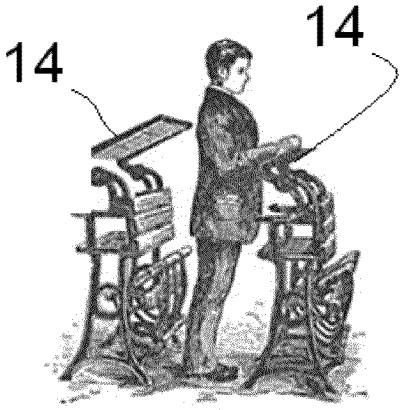
FIG. 2B PRIOR ART
Figure 3:
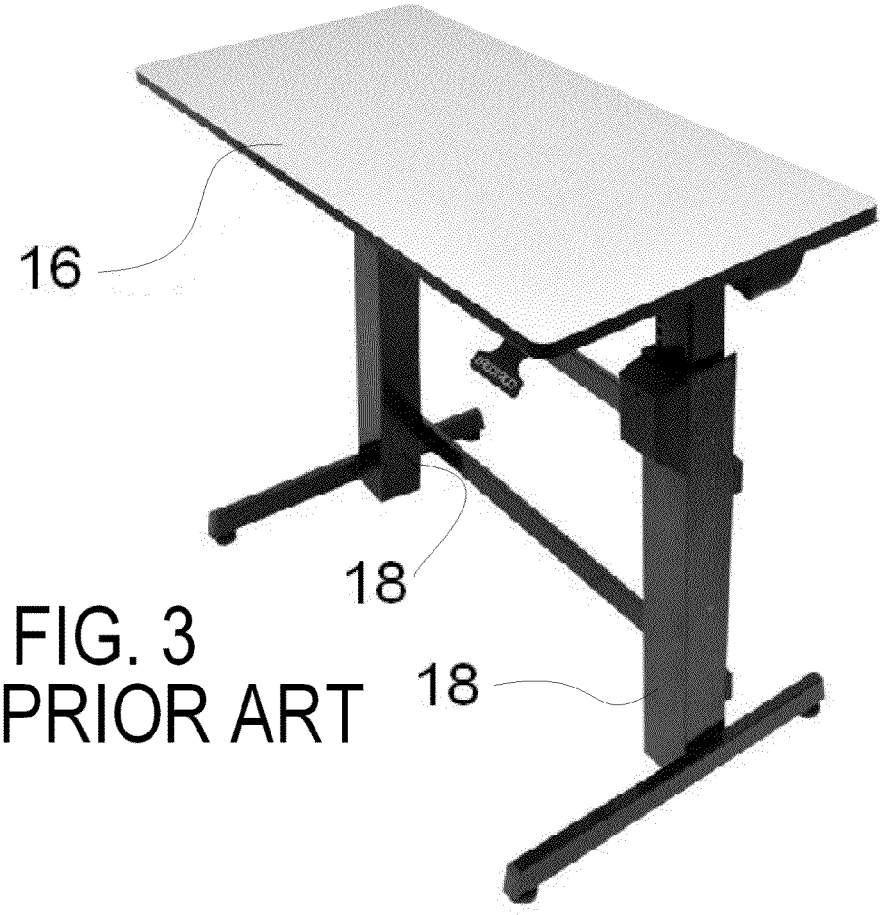
FIG. 3 PRIOR ART
FIG. 3 is a perspective view of a modern commercially available convertible sitting desk and standing desk of the prior art.
Figure 5:
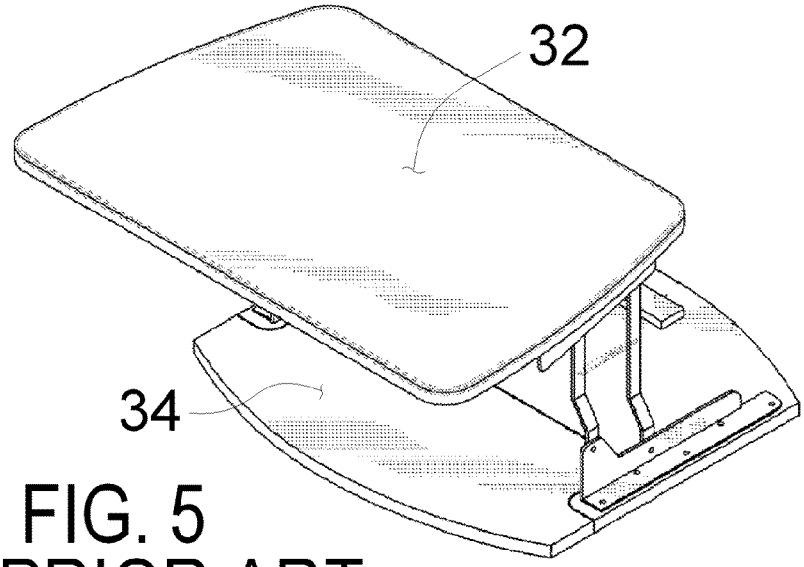
FIG. 5 PRIOR ART
FIG. 5 is a perspective view of a desk mounted vertically adjustable stand up desk that allows a conventional desk to be easily and quickly converted to a stand up desk for the user in accordance with one prior art design.
Figure 4:
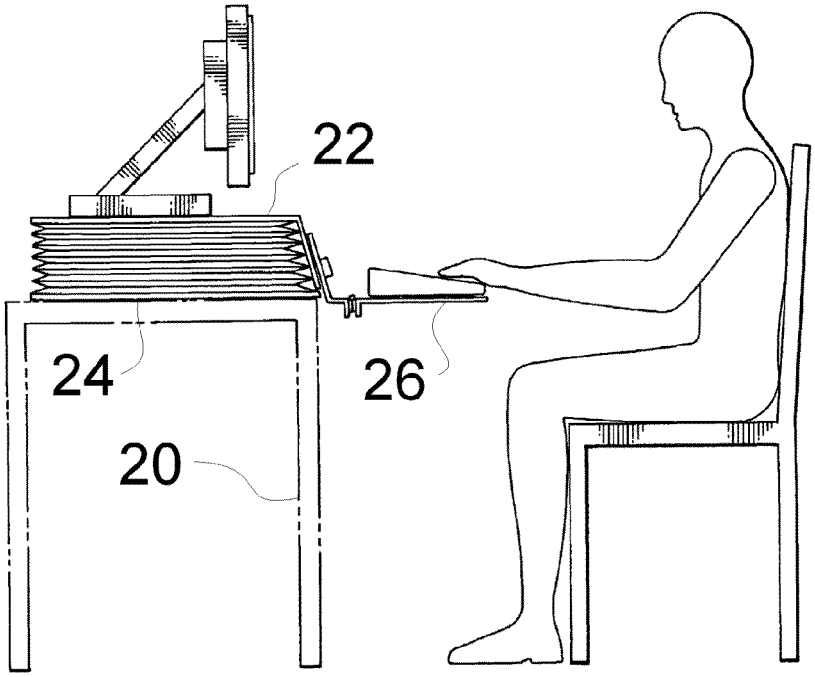
FIG. 4 PRIOR ART
FIG. 4 is a schematic side view of a desk mounted vertically adjustable stand up desk that allows a conventional desk to be easily and quickly converted to a stand up desk for the user in accordance with one prior art design.
Figure 9D:
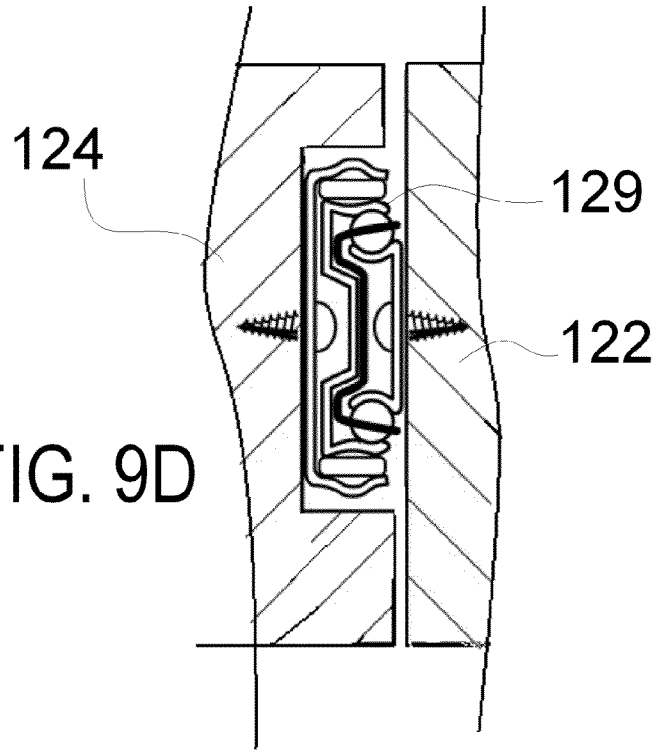
FIG. 9D is a sectional view of a roller bearing drawer slide used in the desk mounted vertically adjustable stand up desk of FIG. 6.

FIGS. 6-12 illustrate a desk mounted vertically adjustable stand up desk 100 that allows a conventional desk 20 to be easily and quickly converted to a stand up desk for the user in accordance with a first embodiment of the present invention. Generally the invention consists of a desk mounted vertically adjustable stand up desk 100 including a base plate 110 adapted to be supported on a surface of a conventional desk 20; a tower 120 vertically extending from the base plate 110; a stand up desk surface member 130 moveably mounted on the tower 120 and configured to be vertically adjustable relative to the base plate 110; and a lock member 140 coupled to the tower 120 and configured to secure the stand up desk surface member 130 in a desired user selected vertical position. The desk mounted vertically adjustable stand up desk 100 further includes a monitor mount 150 coupled to the stand up desk surface member 130 via the tower 120 as further described below, a monitor lock member 160 coupled to the monitor mount 150 and configured to selectively secure the monitor mount 150 in a desired vertical position as further described below, and a pair of optional front stabilizers 170.

Figure 7:
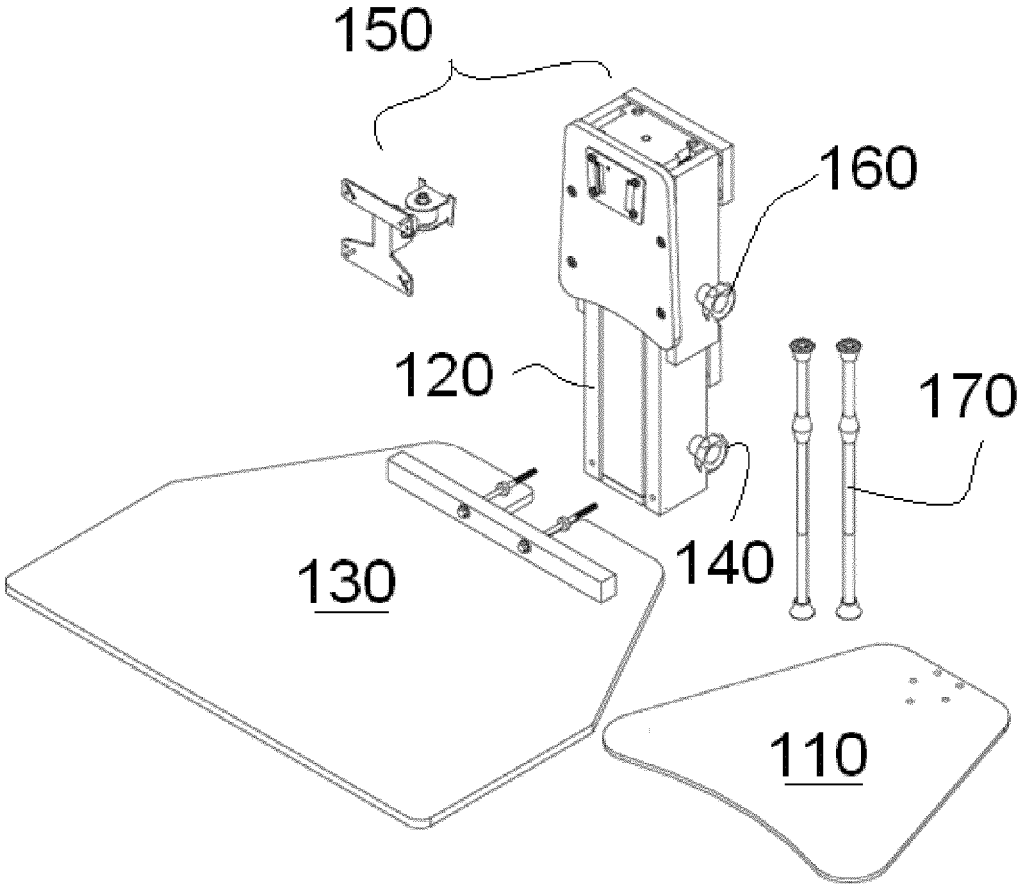
FIG. 7 is a perspective element component or packing view of the desk mounted vertically adjustable stand up desk of FIG. 6.

In addition to the ease of use, the design of the desk mounted vertically adjustable stand up desk 100 allows the system to be easily broken down for shipping as represented in FIG. 7. Further the desk mounted vertically adjustable stand up desk 100 of the invention, as shown, can be easily assembled by the user using only an Allen wrench (or hex key) and single open end wrench (supplied with the sold unit). The construction and design of the desk mounted vertically adjustable stand up desk 100 may be best understood in reviewing the assembly steps attend to by the user.

Figure 8:
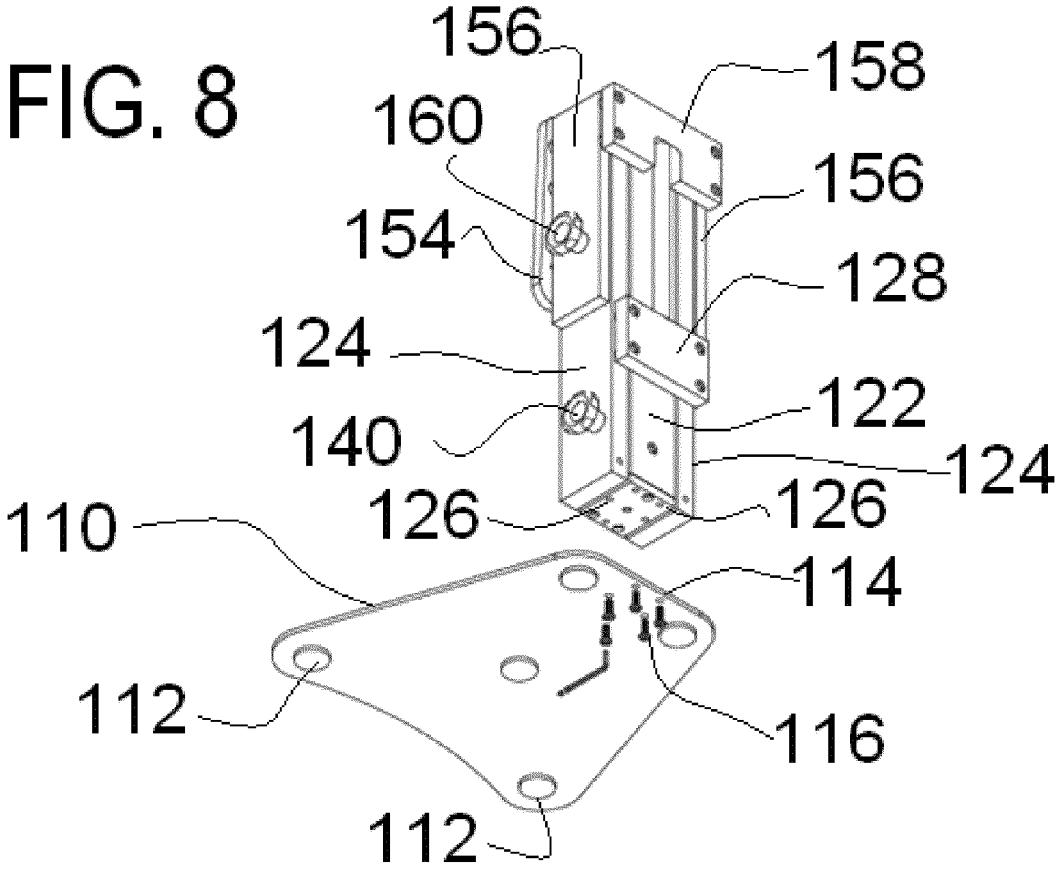
FIG. 8 is a bottom perspective view of the attachment of a base plate to a tower of the desk mounted vertically adjustable stand up desk of FIG. 6.

The initial step in the assembly of a shipped unit is the attachment of the base plate 110 to the tower 120 as schematically illustrated in FIG. 8. The base plate 110 is preferably a rigid, sturdy steel plate with felt pads 112 that are on the surface engaging the desk 20 to prevent marring of the top surface of the desk 20. Rubber or plastic pads may also be used which may add more friction gripping to the system. Other material may be used for the base plate, but steel is efficient and cost effective. The user can use a supplied hex key to attach the tower 120 to the base plate by placing the tower 120 on top of the steel base plate 110 and aligning the tapped holes 126 in a center post 122 of the tower 120 with associated holes 114 through the base plate 110. Bolts 116 can be placed through openings 114 and threaded into tapped holes 126 and tightened with the hex key.

FIG. 8 also provides a clear view of some of the construction of the tower 120. The tower 120 includes a rectangular center post 122 that can be formed easily as a wood structure and has central hole for receipt of a lifting pneumatic cylinder, not shown in detail. In this embodiment the center post 122 pneumatic cylinder is analogous to an automobile rear hatch cylinder (also called stabilizers). Appropriate pneumatic cylinders are available from Grainger, Inc., Wholesalehydraulics, HomCom and Safeco, and will mainly act to offset the weight of the system and the associated monitor 180 and keyboard and computer (e.g., about 20 lbs).

The desk mounted vertically adjustable stand up desk 100 includes a pair of vertically extending opposed slide members 124, generally formed of wood, that are configured to slide vertically relative to the center post 122. A wood brace 128 couples the opposed slide members 124 adding further stability to the unit. Each slide member 124 includes roller bearing or ball bearing elements preferably in the form of ball bearing drawer slides 129 best shown schematically in FIG. 9D, such as available from ROCKLER® woodworking and hardware. Ball bearing drawer slides 129 have a pair of sleeved metal tracks with intervening roller bearings. The construction and operation of drawer slides 129 is generally known in the art and not discussed herein in detail. One track of each ball bearing drawer slide 129 is secured to the center post 122 while the other track of each ball bearing drawer is secured to the slide member 124, however the drawer slide 129 may still be considered as a part of the slide members 124 as it accommodates the motion of the slide member 124 to the center post 122. The use of drawer slides 129 is significant in providing an easily manufactured smoothly adjustable desk 100. The slides 129 may be recessed in channels in the slide members 124 as shown, or alternatively in channels in the center post or a combination thereof.

The lock member 140 includes a manually adjustable friction brake member, effectively formed by a plastic t-bolt or other friction member that is abutted against the center post 122 when the manual knob is rotated in a tightening or engaged direction (clockwise) and will disengage, or engage with less holding force, when the manual knob is rotated in a loosening or disengaged direction (counterclockwise). The operation of manual friction brakes is well known and not detailed herein.

Figure 9A:
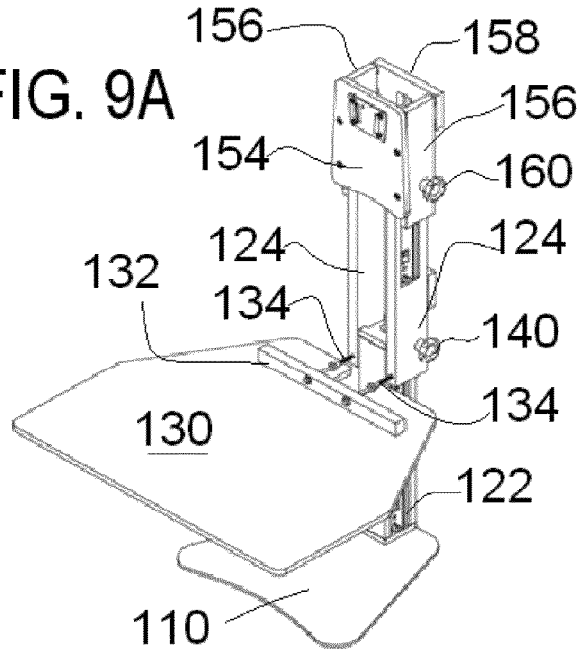
FIG. 9A is a perspective view of the attachment of a stand up desk surface member to the tower of the desk mounted vertically adjustable stand up desk of FIG. 6.
Figure 9B:
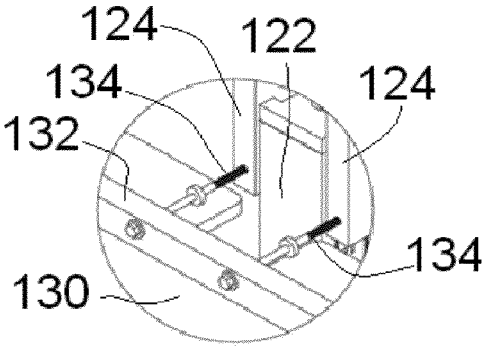
FIG. 9B is an enlarged partial perspective front view of the attachment of FIG. 9A.
Figure 9C:
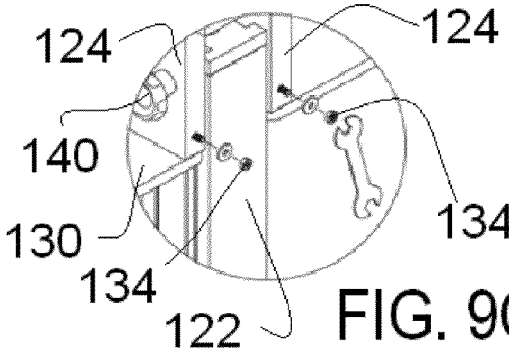
FIG. 9C is an enlarged partial perspective rear view of the attachment of FIG. 9A.
Figure 13:
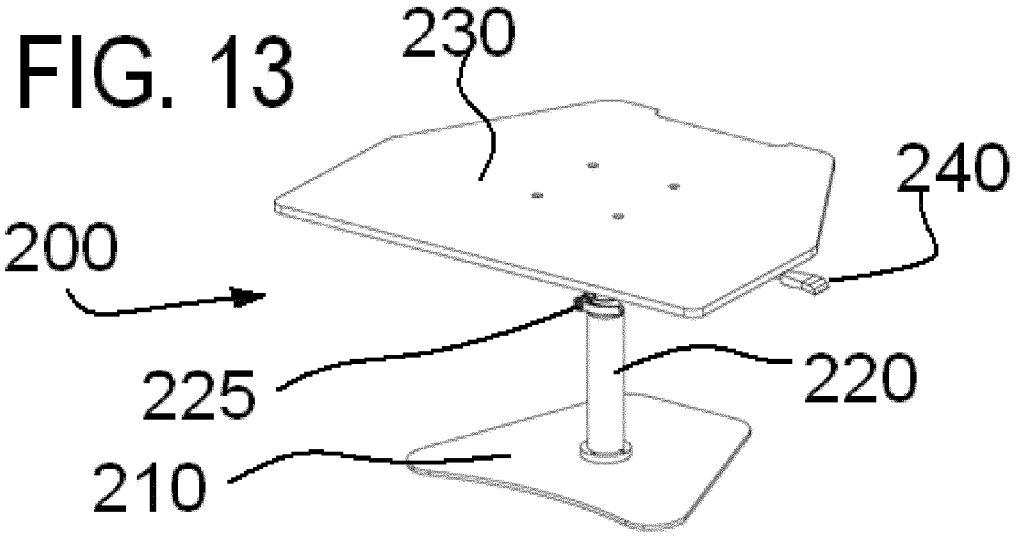
FIG. 13 is a perspective view of a desk mounted vertically adjustable stand up desk that allows a conventional desk to be easily and quickly converted to a stand up desk for the user in accordance with a second embodiment of the present invention.

The second step in the assembly of the shipped unit is the attachment of the desk surface member 130 to the tower 120 as shown in FIGS. 9A-C. The desk surface member 130 includes a raised back crossbar 132 that is used for attachment as shown but can serve independent back stop functionality for the desk (i.e. stop rolling pens, etc). Long nut and bolt fasteners 134, with appropriate washers and spacers, are placed through aligned holes in the crossbar 132 and each slide member 124 as shown with the nut of the fastener 134 tightened with the supplied open end wrench to secure the desk surface member to each of the slide members 124 of the tower 120.

As noted above, the desk mounted vertically adjustable stand up desk 100 further includes a monitor mount 150 coupled to the stand up desk surface member 130 via the tower 120. The monitor mount 150 includes a monitor bracket 152, known as a VERSA bracket, that secures to most monitors 180, and a front plate 154 to which the monitor bracket 152 is coupled, a pair of monitor slide members 158 coupled to the front plate 154 and a back plate 158 coupled to the monitor slide members 156. The monitor mount includes a conventional pneumatic cylinder that can extend between the back plates 158 and 128 to assist in the monitor movement. The bracket 152 allows left and right rotation of the monitor 180 and the user can adjust the force needed to move the monitor 180 by tightening or loosening the top adjustment bolt of the bracket 152 using the supplied open ended wrench. Further the bracket 152 allows the monitor 180 to tilt up or down and the user can adjust the force needed to tilt the monitor 180 by tightening or loosening the side adjustment bolt.

Each monitor slide member 158 includes roller bearing or ball bearing elements preferably in the form of ball bearing drawer slides 129 discussed above and best shown schematically in FIGS. 9D and 9A, such as available from ROCKLER® woodworking and hardware. Ball bearing drawer slides 129 have a pair of sleeved metal tracks with intervening roller bearings. One track of each ball bearing drawer slide 129 is secured to the monitor slide member 158 while the other track of each ball bearing drawer is secured to the slide member 124, however the drawer slide 129 may still be considered as a part of the slide members 158 as here they accommodates the motion of the monitor 180 to the stand up desk surface member 130. Again, the use of drawer slides 129 is significant in providing an easily manufactured smoothly adjustable desk 100. The slides 129 may again be recessed in channels in the slide members 124 as shown, or alternatively in channels in the slide members 158 or a combination thereof.

The monitor lock member 160 is analogous to member 140 and includes a manually adjustable friction brake member, effectively formed by a rubber disc or other friction member that is abutted against the slide member 124 when the manual knob of member 160 is rotated in a tightening or engaged direction (clockwise) and will disengage, or engage with less holding force, when the manual knob is rotated in a loosening or disengaged direction (counterclockwise).

The next step is the securing of the monitor 180 to the unit 100 schematically shown in FIG. 10. As noted the monitor bracket 152 is designed to fit most monitors 180, and a monitor 180 is compatible if there are four screw holes in the center of the back of the monitor 180. If not there are mounting adaptors that can be implemented to adapt most monitors to the bracket 152. In assembly it is recommended that the user place the monitor 180 with the screen facing down on a soft surface that will not scratch the monitor 180, then align the monitor bracket 152 over the four screw holes, and finally use the provided monitor screws to secure the monitor bracket 152 to the computer monitor 180. The user can then lift the monitor 180 with attached bracket 152, and place the rear flange of the monitor bracket 152 into the receiving slots of the front plate 154, and then insertion of provided thumb screw into a small hole above the receiving slots will secure the monitor 180 in place.

Figure 6:
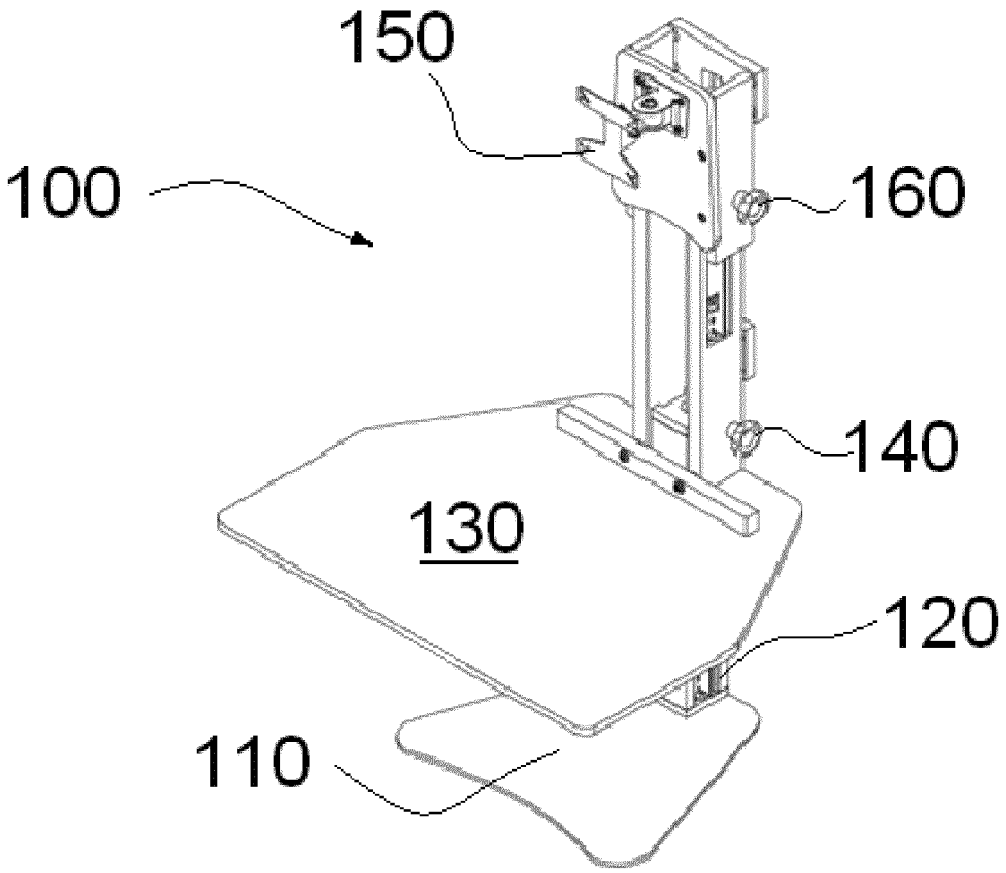
FIG. 6 is a perspective view of a desk mounted vertically adjustable stand up desk that allows a conventional desk to be easily and quickly converted to a stand up desk for the user in accordance with a first embodiment of the present invention.

FIG. 11 is a perspective view of the desk mounted vertically adjustable stand up desk of FIG. 6 illustrating the vertical adjustment. The monitor 180, and keyboard and other supported elements, are not illustrated merely for clarity. For vertical position adjustment of the stand up desk surface member 130, the user will turn the black knob of the member 140 counter-clockwise two or three rotations to loosen the friction brake. This will free the desk surface member 130 to be raised or lowered. The user can gently pull up or push down on the desk surface member 130 if it does not move. If the desk surface member 130 does not move easily, the user is instructed to loosen the knob another ½ rotation and try again. The best location to hold the desk surface member 130 when raising is both hands on the side, towards the rear. The best location to hold the desk surface member 130 when lowering the vertical position is to place the user's hand in the rear center of the desk surface member 130 and slowly push down. The user should avoid pushing down on the forward most portion of the desk surface member 130. With the provision of the piston in center post 122 the desk surface member 130 will move down with less effort when weight from a monitor 180, keyboard and associated desk items has been added.

Once the user sets the desk surface member 130 at a desired height, the desk surface member 130 is secured in position by turning the knob of member 140 clockwise until snug and the desk surface member 130 no longer moves up or down.

The vertical adjustment of the monitor 180 is analagous to the vertical adjustment of the desk surface member 130. For monitor height adjustment the user turns the black knob of the member 160 counter-clockwise two or three rotations to loosen. This will free the monitor 180 to be raised or lowered. The user then gently pulls up or down on the monitor 180. If the monitor 180 does not move, then the user may loosen the knob of member 160 another ½ rotation and try again. Once the user sets the monitor 180 at the desired height, the user turns the knob of member 160 clockwise until snug and the monitor 180 no longer moves up or down.

Figure 12:
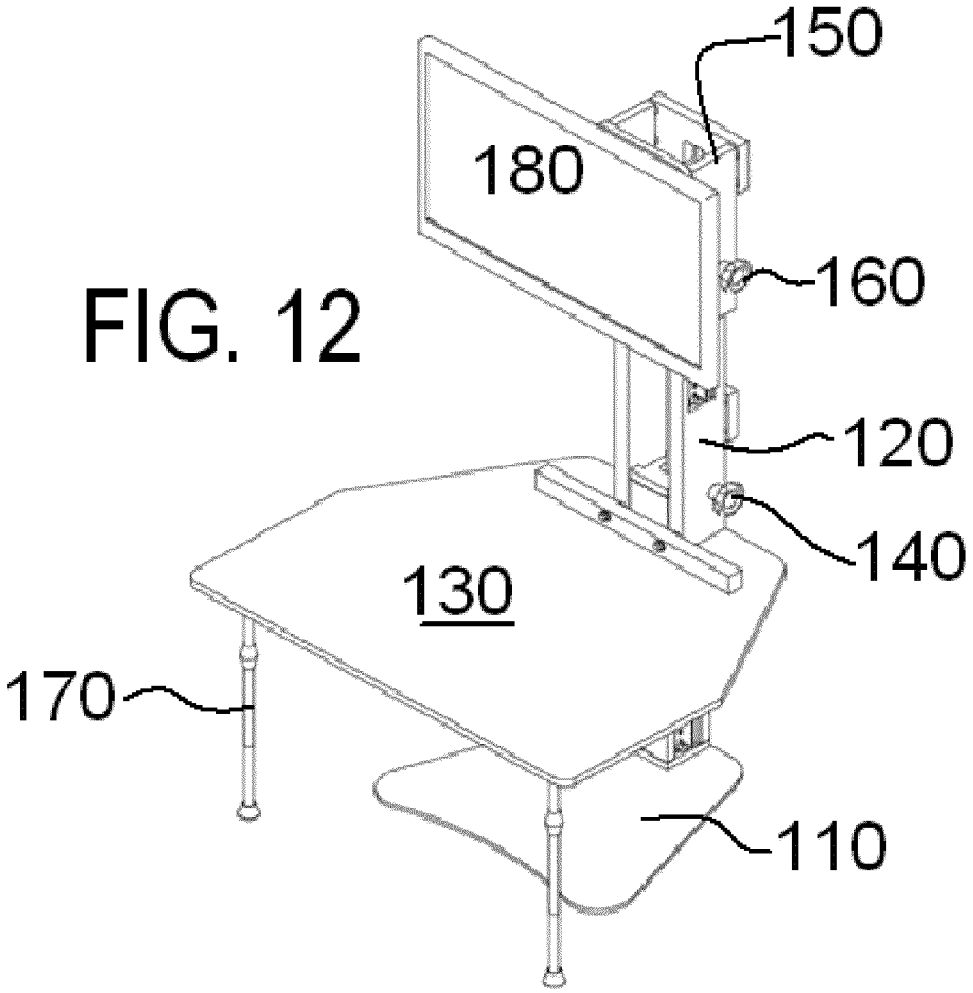
FIG. 12 is a perspective view of the desk mounted vertically adjustable stand up desk of FIG. 6 with stabilizers positioned in a front.

The desk mounted vertically adjustable stand up desk 100 is fully operational without stabalizers 170, however some user's may desire the desk surface member 130 to feel more secure when in the standing position. For this, the two stabilizers 170 are provided. In use them, with the desk surface member 130 at a desired height, the user holds one of the stabilizers 170 under the desk surface member 130 and rotates the bottom of the stabilizer 170 to increase or decrease the length until the stabilizer 170 fits under the desk surface member 130 and provides a light amount of upward force generally as shown in FIG. 12. The user repeats this process for the other stabilizer 170. Optionally a user may elect to only engage one stabilizer 170 in the front center of the desk surface member 170. The unit 100 is designed not to require the use of the stabalizers 170 and they are supplied to provide assurance and general user acceptance of the system.

Figure 14:
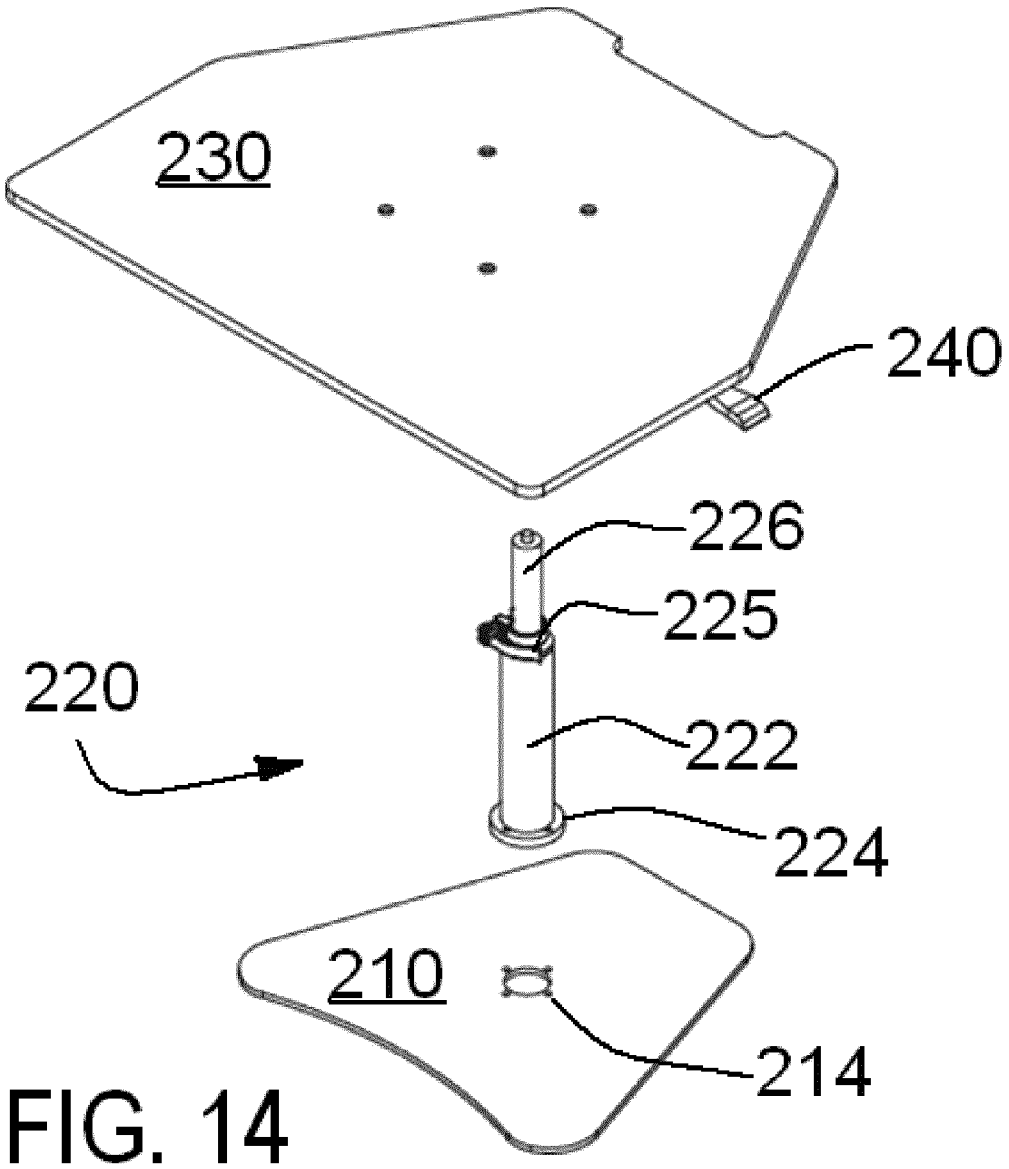
FIG. 14 is a perspective element component or packing view of the desk mounted vertically adjustable stand up desk of FIG. 13.
Figure 15:
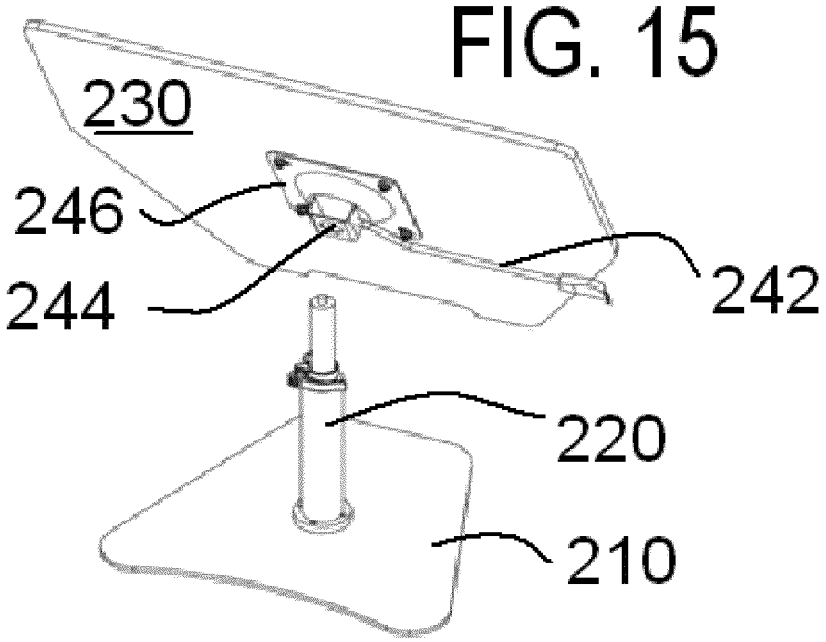
FIG. 15 is a perspective partially exploded view of the desk mounted vertically adjustable stand up desk of FIG. 13.

FIGS. 13-16 illustrate a desk mounted vertically adjustable stand up desk 200 that allows a conventional desk 20 to be easily and quickly converted to a stand up desk for the user in accordance with a second embodiment of the present invention. Generally the invention consists of a desk mounted vertically adjustable stand up desk 200 including a base plate 210 adapted to be supported on a surface of a conventional desk 20; a tower 220 vertically extending from the base plate 210; a stand up desk surface member 230 moveably mounted on the tower 220 and configured to be vertically adjustable relative to the base plate 210; and a lock member 240 coupled to the tower 220 and configured to secure the stand up desk surface member 230 in a desired user selected vertical position. In addition to the ease of use, the design of the desk mounted vertically adjustable stand up desk 200 allows the system to be easily broken down for shipping as represented in FIG. 14. Further the desk mounted vertically adjustable stand up desk 200 of the invention, as shown, can be easily assembled by the user using only an Allen wrench (or hex key) and single open end wrench (supplied with the sold unit).

The base plate 210 is preferably a rigid, sturdy steel plate with felt pads that are on the surface engaging the desk 20 to prevent marring of the top surface of the desk 20 similer to base plate 110 above. Rubber or plastic pads may also be used which may add more friction gripping to the system. Other material may be used for the base plate, but steel is efficient and cost effective. The tower 220 may be attached to the base plate 210 by placing the tower 220 on top of the center of steel base plate 210 and aligning the taped holes in a securing ring 224 of the tower 220 with associated holes 214 through the base plate 210. Bolts can be placed through openings 214 and threaded into tapped holes in the ring 224 and tightened with a hex key.

The tower 220 is formed primarily of a piston 226/cylinder 222 arrangement of the type used to raise and lower office chairs. Most typical adjustable office chairs utilize a pneumatic cylinder to easily raise and lower the height of the seat for the user. The pneumatic cylinder functions by releasing air when the user pulls the appropriate lever while sitting on the chair, and springing back up when the user pulls the lever while standing. See U.S. Pat. No. 5,702,083, which is incorporated herein by reference, for details on the construction of chair type pneumatic cylinders. In the present invention the lever serves as the lock member 240 for the desk 200. Appropriate pneumatic cylinders for the tower 220 are available from Grainger, Inc., Grainger, Inc., Wholesalehydraulics, HomCom and Safeco, and will mainly act to offset the weight of the system and the associated monitor 180 and keyboard and computer (e.g., about 20 lbs).

The pneumatic cylinder tower 220 provides an easily adjusted vertical adjustment to the desk 200. The lock member 240 includes a manually actuated lever or handle 242 extending beneath the stand up desk surface member 230, a bracket 246 to secure the lock member 240 to the stand up desk surface member 230, and a cylinder engagement and release coupled to the pneumatic cylinder and actuated by the lever 242 to allow for adjustment of the stand up desk surface member 230.

Figure 16B:
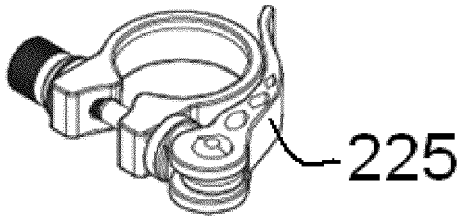
FIGS. 16A and B are enlarged views of a rotational lock in open and closed position for the desk mounted vertically adjustable stand up desk of FIG. 13.
Figure 16A:
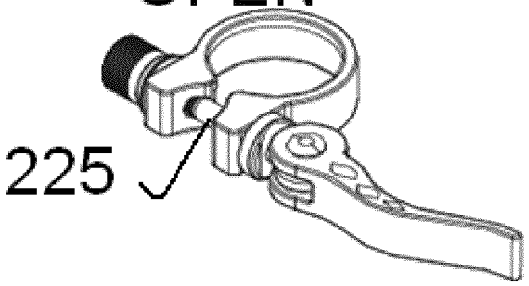

The tower 220 configuration allows for rotation of the stand up desk surface member 230 relative to the base 210. FIGS. 16A and B are enlarged views of a rotational lock 225 for the tower 220 in open (FIG. 16 A) and closed (FIG. 16 B) position for the desk mounted vertically adjustable stand up desk 220. The ability to rotate the stand up desk surface member 230 gives greater functionality to the user. The desk mounted vertically adjustable stand up desk 200 is shown with no separate monitor mount. If desired a monitor mount, including adjustable mounts, may be secured to the stand up desk surface member 230.

In operation, if a different height is desired for the stand up desk surface member 230, the user simply pulls the lever 242 up and the gas piston 226 will raise the desk surface member 230. The user stops the desk surface member 230 from rising by releasing the lever 242. The user can manually assist the raising by gripping the sides of the stand up desk surface member 230 and pulling up when the lever 242 is engaged. In order to lower the desk surface member 230 the user will pull the height adjustment lever 242, then while holding the lever in the upward engaged position the user will push down on the desk surface member 230 directly in the center. Once the desired height for the stand up desk surface member 230 is reached, the user will release the lever 242.

It will be apparent the described embodiments are illustrative of the present invention and not restrictive thereof. Many variations to the present invention would be obvious to those of ordinary skill in the art, without departing from the spirit and scope of the present invention. The present invention is defined by the appended claims and equivalents thereto.

What is claimed is:

1. A desk mounted vertically adjustable stand up desk comprising:

A base plate adapted to be supported on a desk surface;

A tower vertically extending from the base plate mounted to a rear edge of the base plate and the tower including a central post and a pair of vertically extending opposed slide members, wherein each slide member includes a ball bearing drawer slide having a pair of sleeved tracks with intervening roller bearings, wherein one sleeved track of each pair of sleeved tracks is attached to the central post;

A stand up desk surface member moveably mounted to the pair of slide members on the tower and configured to be vertically adjustable relative to the base plate;

A monitor mount coupled to the stand up desk surface member, wherein the monitor mount is coupled to the stand up desk surface via the slide members; and A lock member coupled to the tower and configured to secure the stand up desk surface member in a desired user selected vertical position, wherein the lock member includes a manually adjustable friction brake member.

2. The desk mounted vertically adjustable stand up desk according to claim 1, wherein the monitor mount is vertically adjustable relative to the slide members and the stand up desk surface member.

3. The desk mounted vertically adjustable stand up desk according to claim 2, further including a monitor lock member coupled to the monitor mount and configured to selectively secure the monitor mount in a desired vertical position.

4. The desk mounted vertically adjustable stand up desk according to claim 3, wherein the monitor lock member includes a manually adjustable friction break member.

5. A desk mounted vertically adjustable stand up desk comprising:

A base plate adapted to be supported on a desk surface;

A tower vertically extending from the base plate mounted to a rear edge of the base plate and a pair of vertically extending opposed slide members, wherein each slide member includes a ball bearing drawer slide having a pair of sleeved tracks with intervening roller bearings; wherein the tower includes a center post receiving a lifting cylinder therein and one sleeved track of each slide member is secured to the center post;

A stand up desk surface member moveably mounted on the tower and configured to be vertically adjustable relative to the base plate via the slide members;

A lock member coupled to the tower and configured to secure the stand up desk surface member in a desired user selected vertical position; and A monitor mount coupled to the stand up desk surface member, wherein the monitor mount is vertically adjustable relative the stand up desk surface member.

6. The desk mounted vertically adjustable stand up desk according to claim 5, further including a monitor lock member coupled to the monitor mount and configured to selectively secure the monitor mount in a desired vertical position.

* * * * *